US012575660B2

(12) United States Patent
Campbell et al.

(10) Patent No.: US 12,575,660 B2
(45) Date of Patent: Mar. 17, 2026

(54) BACKPACK WITH CLIP

(71) Applicant: Under Armour, Inc., Baltimore, MD (US)

(72) Inventors: Derek Campbell, Baltimore, MD (US); Bradley Johnson, Baltimore, MD (US); Alexander Prokopik, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 105 days.

(21) Appl. No.: 17/150,034

(22) Filed: Jan. 15, 2021

(65) Prior Publication Data

US 2021/0212443 A1 Jul. 15, 2021

Related U.S. Application Data

(60) Provisional application No. 62/961,391, filed on Jan. 15, 2020.

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 3/04; A45F 2003/001; A45F 3/047; A45F 2003/045; A45F 3/08; A45F 3/02; A45C 2013/306; A44B 11/2596; A44B 11/006; A44B 11/12
USPC ..... 224/650, 623, 638, 673, 249
See application file for complete search history.

(56) References Cited

U.S. PATENT DOCUMENTS 5,573,155 A * 11/1996 Sadler ..... A45F 4/02 224/155
6,626,342 B1 * 9/2003 Gleason ..... A45F 3/08 224/652
8,567,652 B2 * 10/2013 Di Stasio ..... A45F 3/04 224/645
8,807,411 B2 * 8/2014 Meyer ..... A45F 3/04 224/627
10,123,592 B2 * 11/2018 Raymond ..... A45F 5/02
2016/0040958 A1 * 2/2016 Alcantra ..... A45F 3/06 224/182
2016/0169632 A1 * 6/2016 Holtz ..... F41H 5/0428 89/36.02
2019/0269206 A1 * 9/2019 Kolasa ..... A44B 11/12
(Continued)

FOREIGN PATENT DOCUMENTS

CA 2465050 A1 * 10/2005 ..... A45F 5/021
WO WO-2012142544 A2 * 10/2012 ..... A45F 3/06

*Primary Examiner* — Nathan J Newhouse
*Assistant Examiner* — Matthew T Theis
(74) *Attorney, Agent, or Firm* — Edell, Shapiro & Finnan, LLC

(57) ABSTRACT

A backpack includes a main body including a front side and a rear side, a pair of shoulder straps extending from the rear side, where at least one of the shoulder straps includes a rail disposed on a surface of the shoulder strap that opposes the rear side, and a clip that secures to the rail of the shoulder strap. The clip includes a rail securing member that secures to the rail, and an accessory engagement member that supports an item by the backpack via the clip when the backpack is worn by a user.

14 Claims, 14 Drawing Sheets

(56) References Cited

U.S. PATENT DOCUMENTS

| | | | | |
|---|---|---|---|---|
| 2019/0380478 | A1* | 12/2019 | Rushing | A45F 4/02 |
| 2021/0196029 | A1* | 7/2021 | Dabrowka | F41H 1/02 |

* cited by examiner

BACKPACK WITH CLIP

CROSS-REFERENCE TO RELATED APPLICATION

This application claims priority from U.S. Provisional Patent Application Ser. No. 62/961,391, filed Jan. 15, 2020, the disclosure of which is incorporated herein by reference in its entirety.

FIELD OF THE INVENTION

The present invention relates to a backpack.

BACKGROUND OF THE INVENTION

Backpacks are becoming increasingly popular on college campuses as well as in business environments for transporting items and even portable electronic devices, such as laptops, smart phones, etc. With the number of items a person may need to transport with them for any given scenario, it is often desirable to provide further features for a backpack to enhance its versatility and functionality.

BRIEF SUMMARY OF THE INVENTION

In example embodiments, a backpack comprises a main body or frame including a front side and a rear side, a pair of shoulder straps extending from the rear side, where at least one of the shoulder straps includes a rail disposed on a surface of the shoulder strap that opposes the rear side, and a clip that secures to the rail of the shoulder strap. The clip comprises a rail securing member that secures to the rail, and an accessory engagement member that supports an item by the backpack via the clip when the backpack is worn by a user.

In another embodiment, a backpack comprises a main body including a front side and a rear side, a shoulder strap extending from the rear side, and an accessory engagement member that is removably secured to the shoulder strap. The accessory engagement member includes a curved member that extends outward and away from the shoulder strap when the accessory engagement member engages the shoulder strap, and the curved member facilitates support of an item engaged with the curved member.

In a further embodiment, a clip that is securable to a shoulder strap of a backpack comprises a rail securing member that secures to a rail of the shoulder strap, and an accessory engagement member that supports an item by the backpack via the clip when the backpack is worn by a user.

In other embodiments, the backpack includes additional features such as a pocket defined between interior and exterior surfaces of a panel of the backpack, where the pocket includes a first opening that is accessible via the interior surface and a second opening that is accessible via the exterior surface.

In still further embodiments, that backpack can include a molded sheet that is integrated with an exterior surface of the backpack and defines a molle board to facilitate support and transport of items (e.g., car keys or other items) that are also easily accessible to be removed/separated from the backpack.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION OF THE INVENTION

Figure 1A:
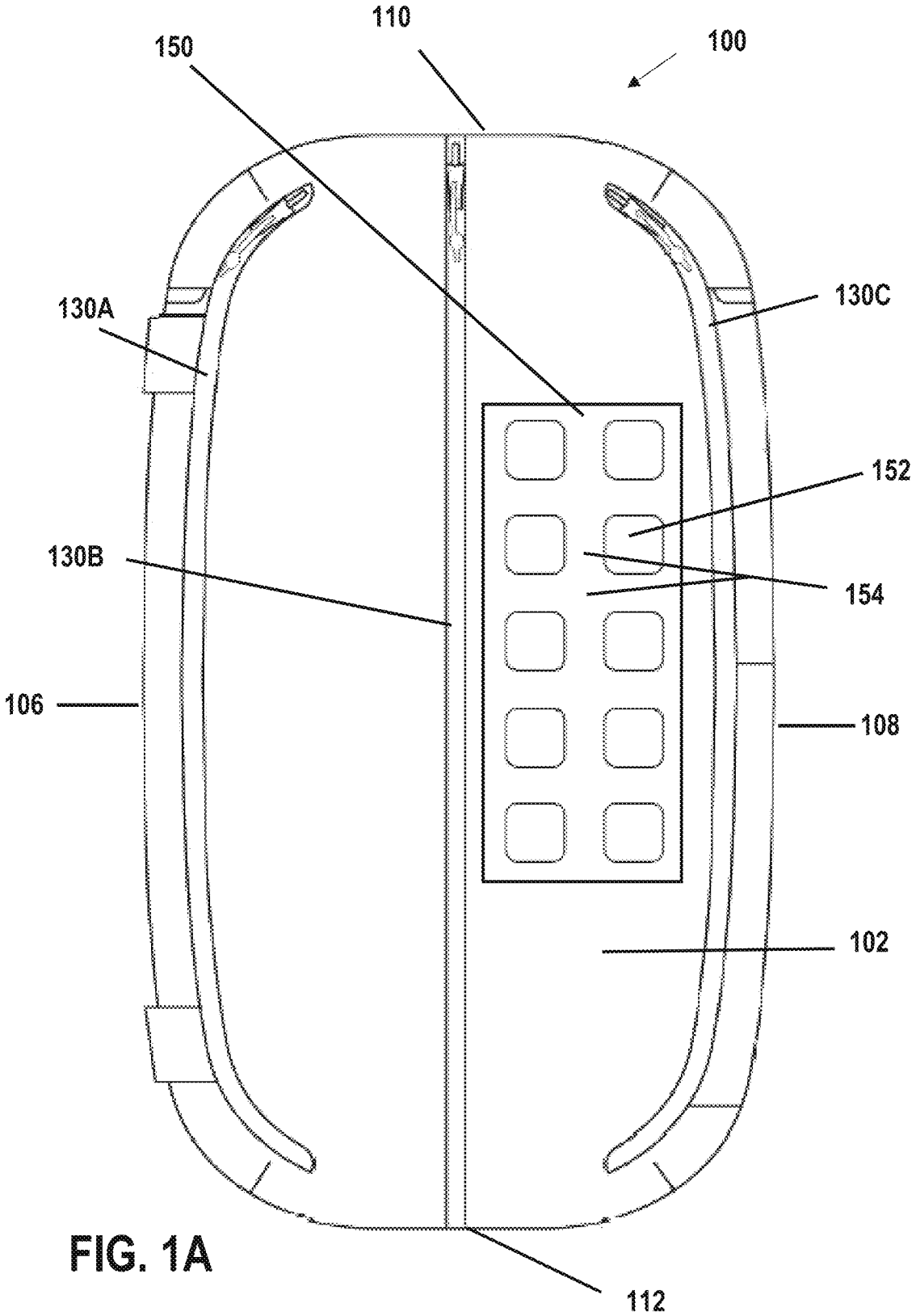
FIG. 1A is a front side view of a backpack in accordance with an embodiment of the invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As described herein, a backpack is configured to include a number of versatile and functional features, including the provision of a backpack clip that couples with the backpack and is further structured to support an item or article while the backpack is being worn by a user. The backpack includes other useful features including the provision of a dual access pocket (e.g., to retain a laptop, other personal electronic component and/or any other suitable item) that permits access both internally (within a cavity of the backpack) and externally (outside the cavity of the backpack) by the user. Further still, the backpack can include an external feature of a modular support structure secured with an external surface of the backpack to facilitate coupling of additional items to the backpack during use. Other useful and versatile features for the backpack are also described in detail herein.

Figure 1B:
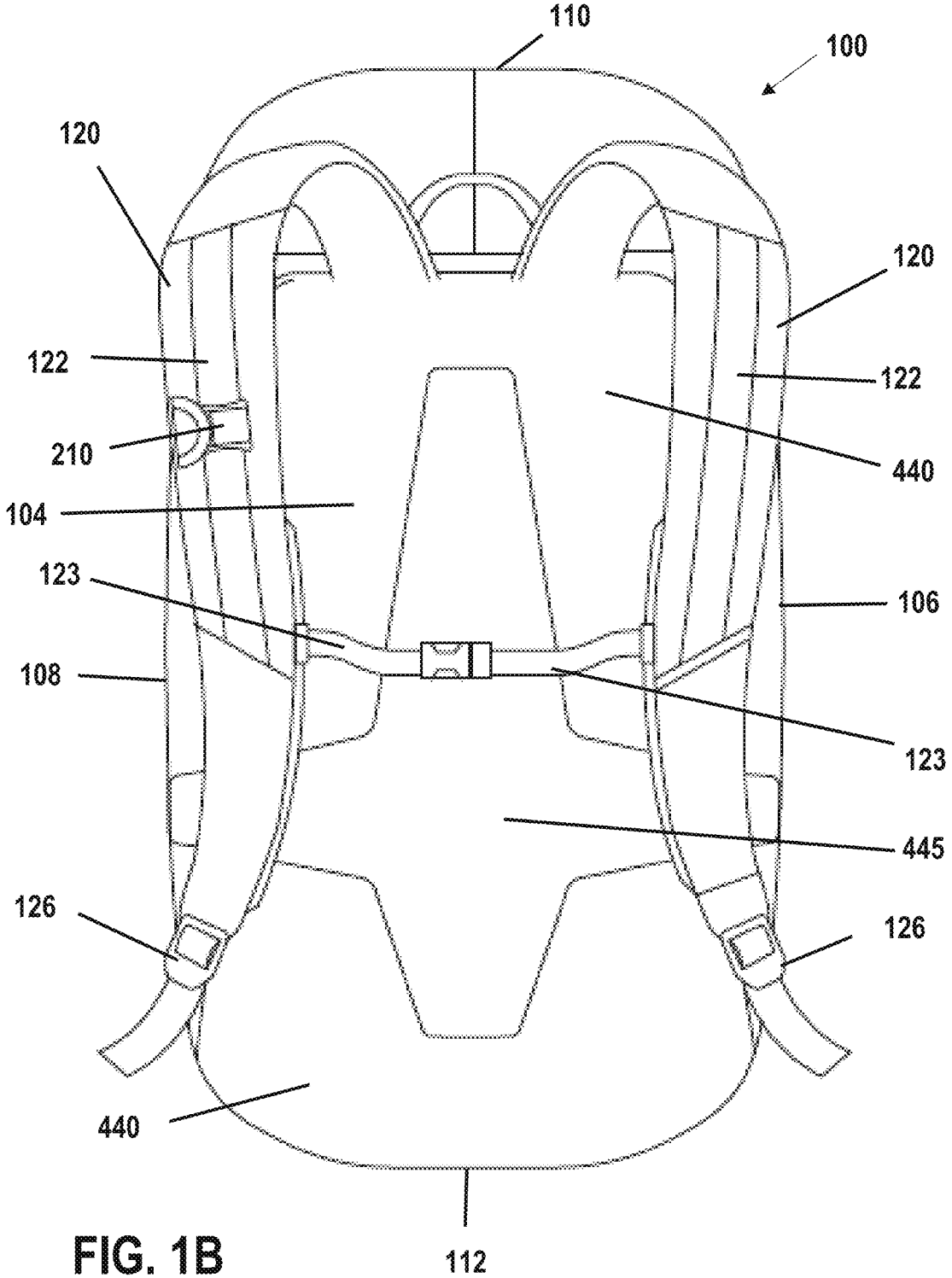
FIG. 1B is a rear side view of the backpack of FIG. 1A and including a clip that facilitates support of additional items when the backpack is worn by a user.
Figure 1C:
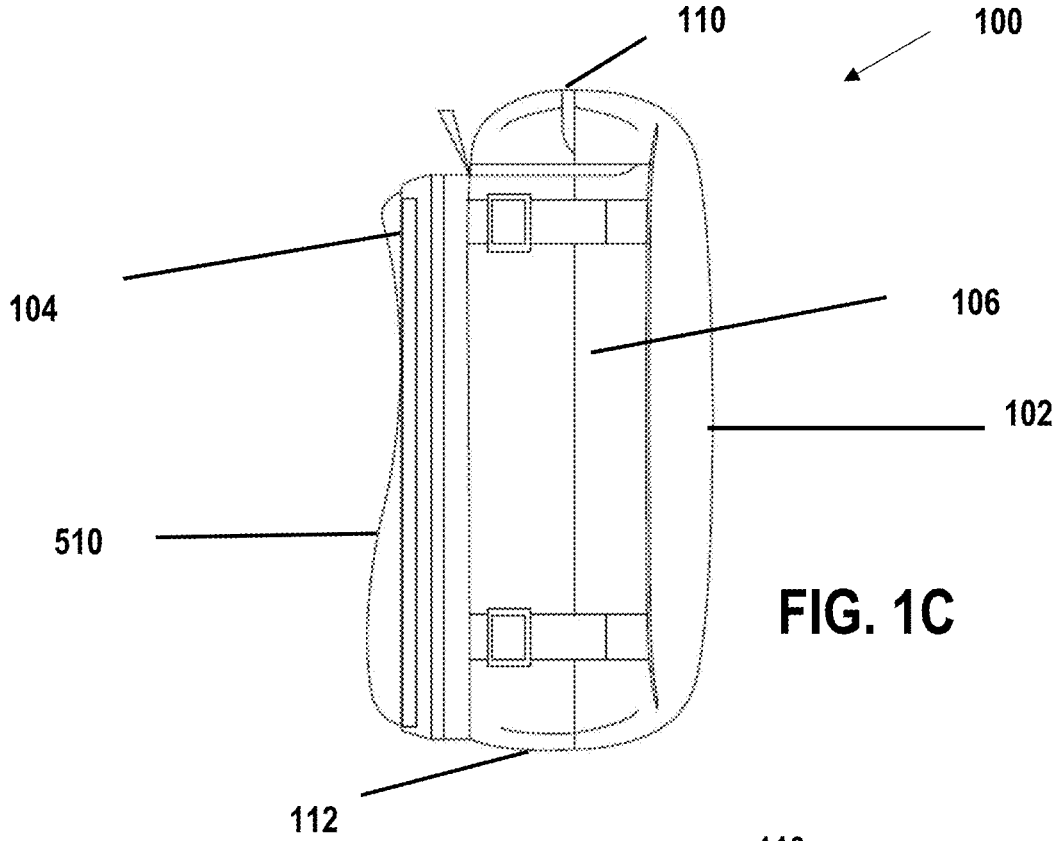
FIGS. 1C and 1D are opposing first (left) and second (right) lateral side views of the backpack of FIG. 1A.
Figure 1D:
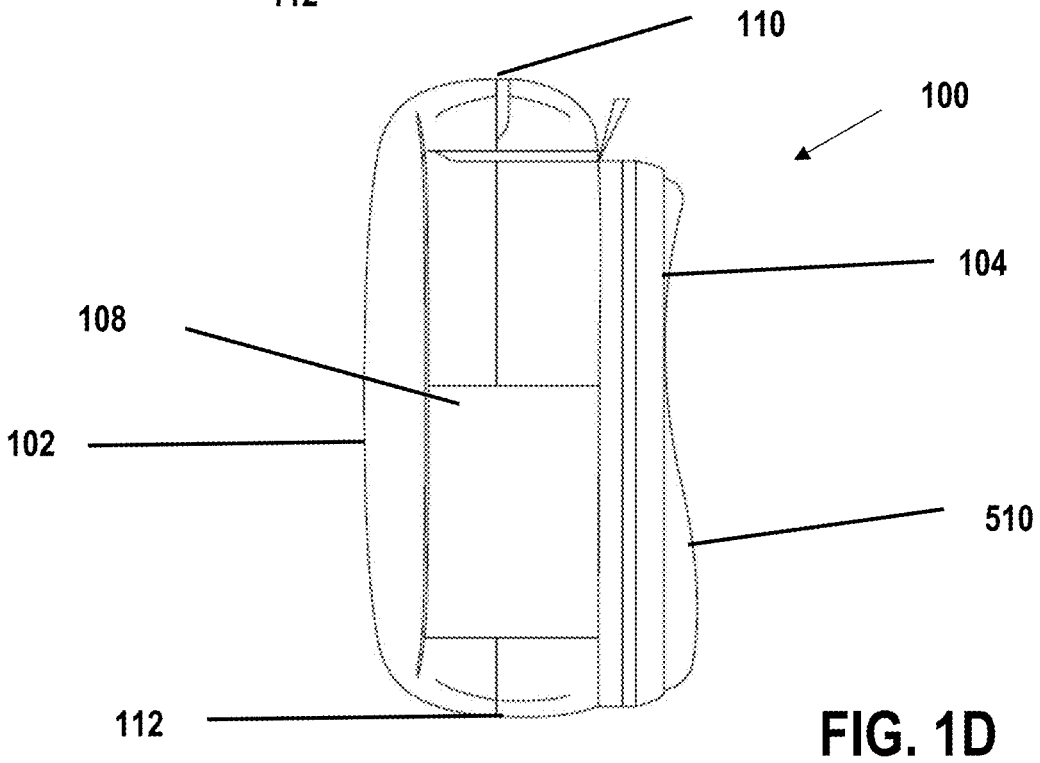

Referring to FIGS. 1A-1F, a backpack 100 comprises a main body or frame that is formed of one or more suitable materials and includes a front side 102 (FIG. 1A), a rear side 104 (FIG. 1B) that faces a user when the user is wearing the backpack as described herein, a top side 110, a bottom side 112, and two opposing sides that connect with the front and rear sides of the backpack. In particular, the backpack 100 includes a first lateral or left side 106 (FIG. 1C) and a second lateral or right side 108 (FIG. 1D). The front, rear, left, right, top and bottom sides 102, 104, 106, 108, 110, 112 of the backpack 100 combine to form a plurality of cavities, compartments or enclosures of varying sizes within the backpack for storing items (e.g., books, articles of apparel, electronic devices such as laptops and smart phones, etc.). In addition, as described herein, some of the compartments or enclosures have dual accessibility or are accessible from both the exterior and the interior (i.e., between panels) of the backpack. The sides of the backpack combine to define a generally elongated or rectangular shape in which a longer or lengthwise dimension of the backpack extends between the top side 110 and bottom side 112 (and thus a widthwise dimension of the backpack extends between the left side 106 and the right side 108, and a thickness dimension of the backpack extends between the front side 102 and the rear side 104).

The sides of the backpack 100 are formed of one or more panels (e.g., each side can be formed comprising a single, separate panel or two or more panels or, alternatively, two or more sides can be formed from one or more of the same panels). In embodiments in which the sides of the backpack are formed with two or more panels, the panels can be connected or secured to each other via any suitable connection (e.g., via a sewn or knitted seam, via lamination or any other suitable connection). As described in further detail herein, at least one side (the rear side) includes a plurality of panels that are separable from each other to define a pocket or enclosure therebetween.

The panels that form the sides of the backpack can be constructed of any suitably lightweight, flexible and tear resistant materials including textiles or fabrics that are formed with any one or more suitable types of polymer materials, where the fabrics can further be formed in any suitable manner (e.g., any combinations of polymer fibers, yarns and/or filaments that form a fabric panel via knitting, weaving, nonwoven formation, etc.). Any suitable polymer materials can be used to form the fabric panels including, without limitation, polyamides (e.g., nylon materials), polyurethanes, polyolefins (e.g., polyethylenes, polypropylenes, etc.), polyesters (e.g., polyethylene terephthalate), polyacrylamides, polylactic acids, polyvinyl alcohol, and any variety of copolymers or combinations thereof. In addition, any one or more panels can be formed at least partially of elastomeric materials to provide a certain degree of elasticity to the fabric panel (e.g., to provide 2-way or 4-way stretch to a portion of the panel), where some non-limiting examples of elastic or stretchable fabric materials suitable for forming the outer fabric layer are fabrics comprising one or more combinations of polyester-polyurethane copolymers referred to generally as elastane (e.g., Spandex or Lycra materials).

Each panel forming a side or portion of a side of the backpack can further include one or more layers of material. For example, a panel that defines a portion of one or more sides of the backpack can include two or more layers, including an interior surface layer (i.e., an inward or enclosure facing layer) and an exterior surface layer (i.e., a layer that defines a portion of an exterior side of the backpack). One or more intermediate layers can also be provided within a panel (i.e., between the interior and exterior surface layers) that provides certain features for the panel. For example, one or more intermediate layers can comprise a foam material (e.g., polyurethane foam) to enhance the cushioning of the panel along one or more sides of the backpack. One or more interior layers can also include a hard and rigid material (e.g., a hard plastic, metal or other suitable material) to enhance the rigidity of the panel at certain locations of the backpack where it may be desired to provide greater stiffness or enhanced structural support. As described in further detail herein, a panel that forms a portion of the rear side 104 of the backpack 100 includes a curved material that is shaped to generally conform with the contour of a user's back at a location where the backpack is worn.

Referring to FIG. 1A, the front side 102 of the backpack 100 includes a plurality of sections that are separable from each other to define openings that facilitate entry into one or more enclosures defined between the sides of the backpack. In the example embodiment of the figures, the front side 102 includes a series or plurality of lengthwise extending openings or slots 130 that can be selectively opened and closed utilizing a zipper or any other suitable fastening structure, where the slots separate sections of the front side from each other to permit access to separate pockets, compartments or enclosures defined along the front of the backpack 100. The compartments or enclosures defined by panels within the backpack can be separate from each other (i.e., distinct spatial enclosures which do not extend to other distinct spatial enclosures defined within the backpack). Many of the compartments or enclosures of the backpack also have a single entry or access opening or slot. However, some of the compartments or enclosures can have two or more access openings or slots as described herein.

In the embodiment depicted in FIG. 1A, the front side 102 of the backpack 100 includes three slots 130 including zippers that permit selective opening and closing of the slot, where a slot 130A is located at or near a lengthwise edge between the front side 102 and left side 106, a slot 130C is located at or near a lengthwise edge between the front side 102 and the right side 108, and a further slot 130B is located at approximately a central location of the front side 102. The slots 130A, 130C at the lengthwise edges of the front side 104 can further be curved slightly at the slot ends so as to extend near and slightly along the top and bottom edges of the front side. Each slot 130 provides an opening (which can be closed with the zipper) to its own separate and isolated enclosure or compartment (defined between two or more layers of the backpack at the front side) to facilitate storage of items within each enclosure during use of the backpack 100.

Figure 1E:
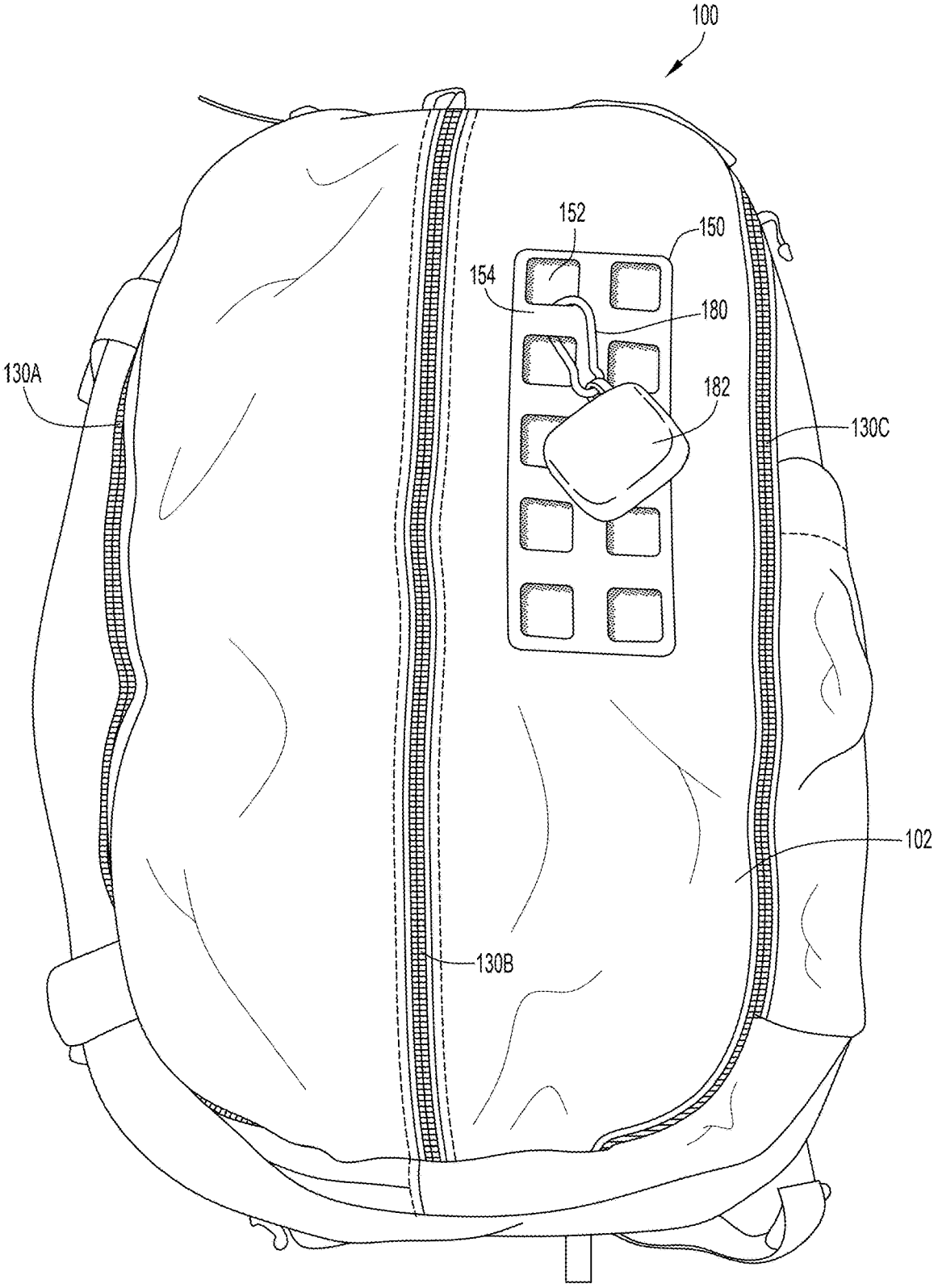
FIG. 1E is another front side view of the backpack of FIG. 1A including an item secured to the molle portion of the backpack.
Figure 1F:
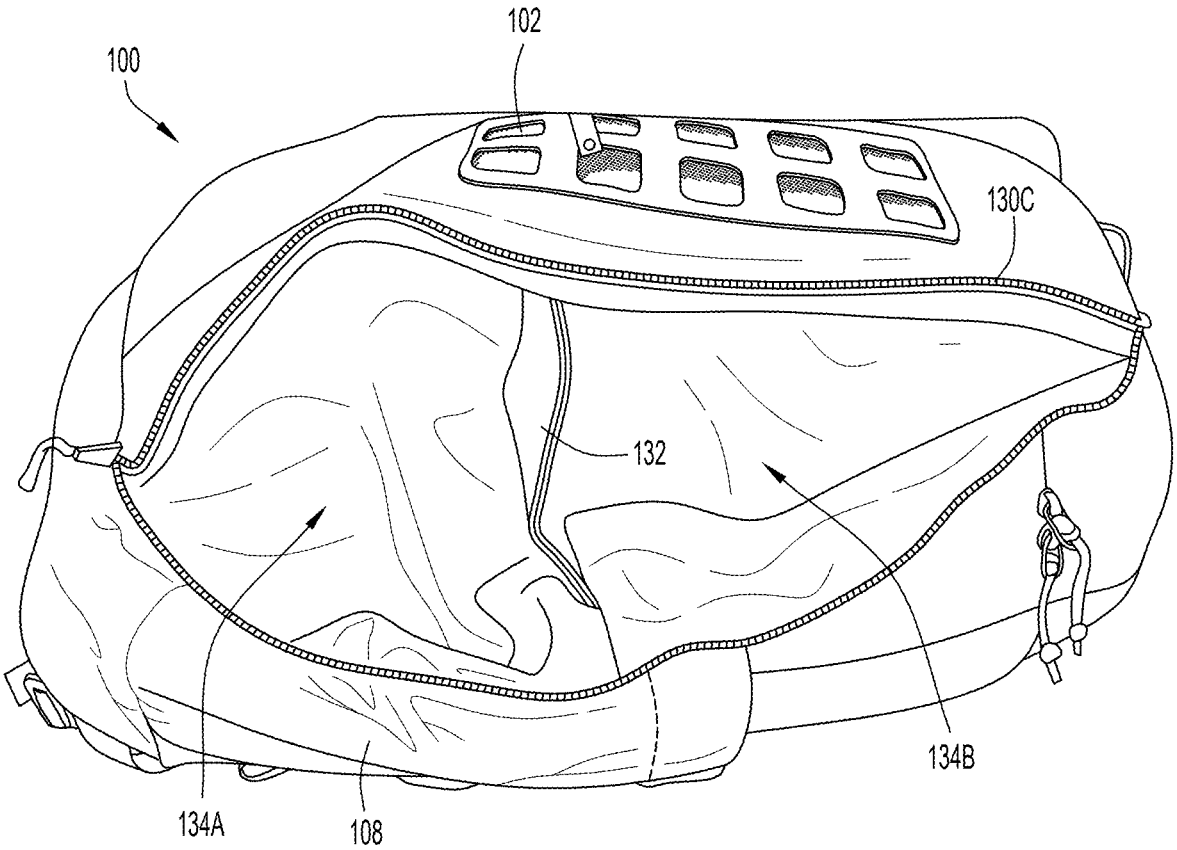
FIG. 1F is a view at the second (right) lateral side of the backpack including an enclosure with a divider.

Each enclosure that is accessible via each slot 130 includes an interior layer or lining formed of a suitable flexible material. One or more of the enclosures can further be segregated into two or more sub-pockets or sub-enclosures (e.g., via additional panels or layers within a primary enclosure that defines a secondary enclosure within the primary enclosure). In an example embodiment of the backpack 100, as depicted in FIG. 1F, the enclosure accessible via slot 130C includes an internal panel or divider 132 that separates the enclosure into two segregated sub-enclosures 134A and 134B. In addition, the materials forming the interior panels or layers of one or more enclosures can be constructed of a suitable breathable fabric material (e.g., nylon or polyester) and/or can include a suitable lining or formed of a material that provides a suitable waterproof barrier within the enclosure. Referring again to FIG. 1F, each sub-enclosure 134A, 134B includes a surface comprising polyurethane or other suitable material that provides a waterproof barrier to substantially minimize or prevent moisture from escaping the sub-enclosure to other enclosures and/or other portions of the backpack 100. Thus, such enclosures permit securing of articles of apparel that may have a certain level of moisture (e.g., water bottles, wet shoes, damp clothing, etc.) within the enclosures while minimizing or preventing such moisture from escaping the enclosures and potentially damaging other items being stored within the backpack.

Referring to FIG. 1B, the rear side 104 of the backpack 100 includes a pair of shoulder straps 120, with each shoulder strap being aligned at or near a widthwise end of the rear side 104 and extending in a lengthwise direction of the backpack (i.e., between the top side 110 and the bottom side 112). One end of each shoulder strap 120 connects at a top location of the backpack at or near the top side 110 and/or a portion of the rear side 104 that is in close proximity with the top side 110. The other end of each shoulder strap 120 connects at a bottom location of the backpack at or near the bottom side 112 and/or a portion of the rear side 104 that is in close proximity with the bottom side 112.

Figure 2A:
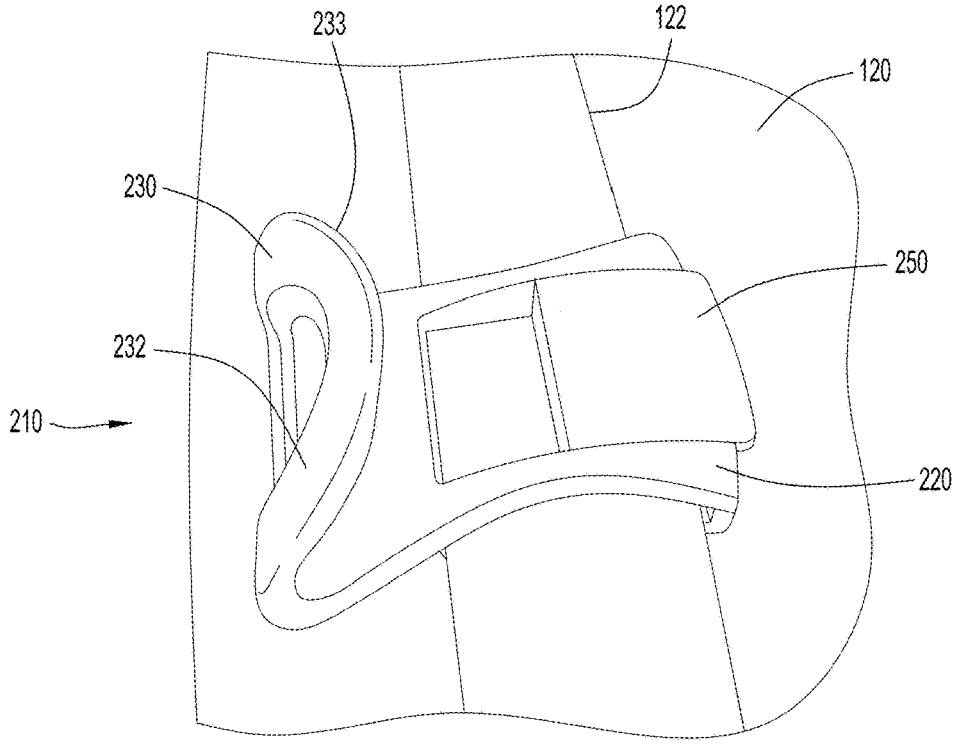
FIGS. 2A and 2B are enlarged and partial views of a portion of the backpack of FIG. 1A showing a strap with the clip coupled to the strap according to an example embodiment of the invention.
Figure 2B:
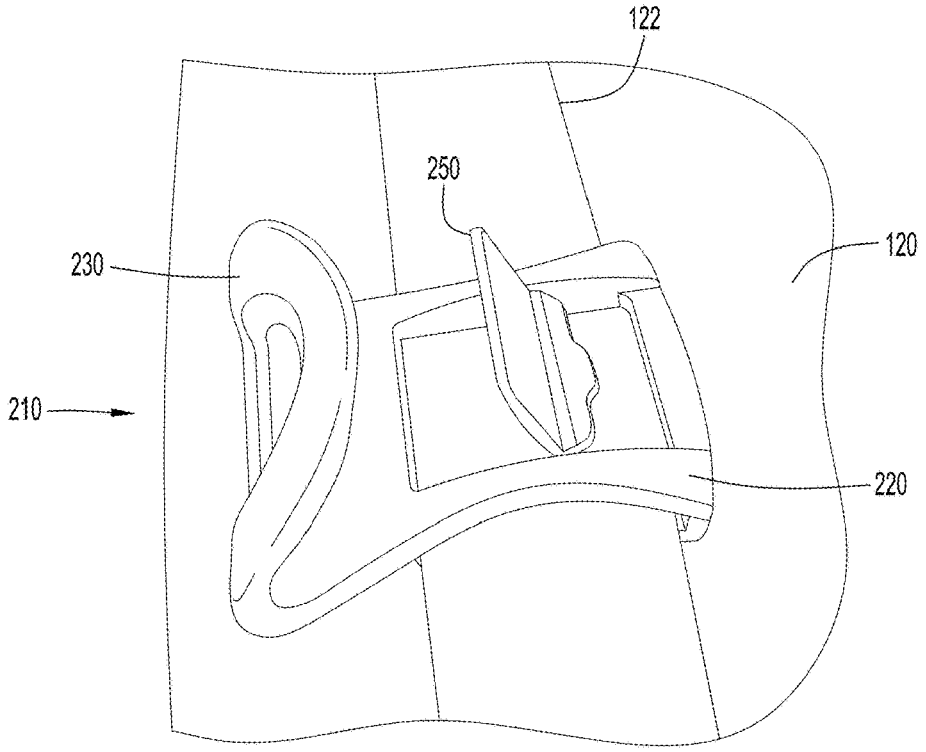
Figure 2C:
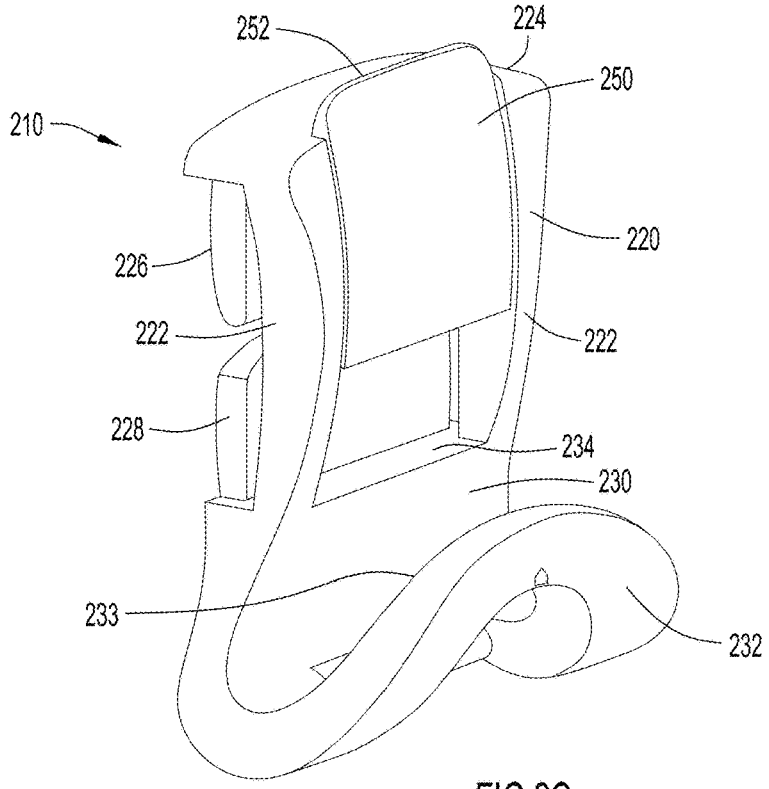
FIGS. 2C-2E depict different views of the clip in isolation for the backpack shown in FIGS. 2A and 2B.
Figure 2D:
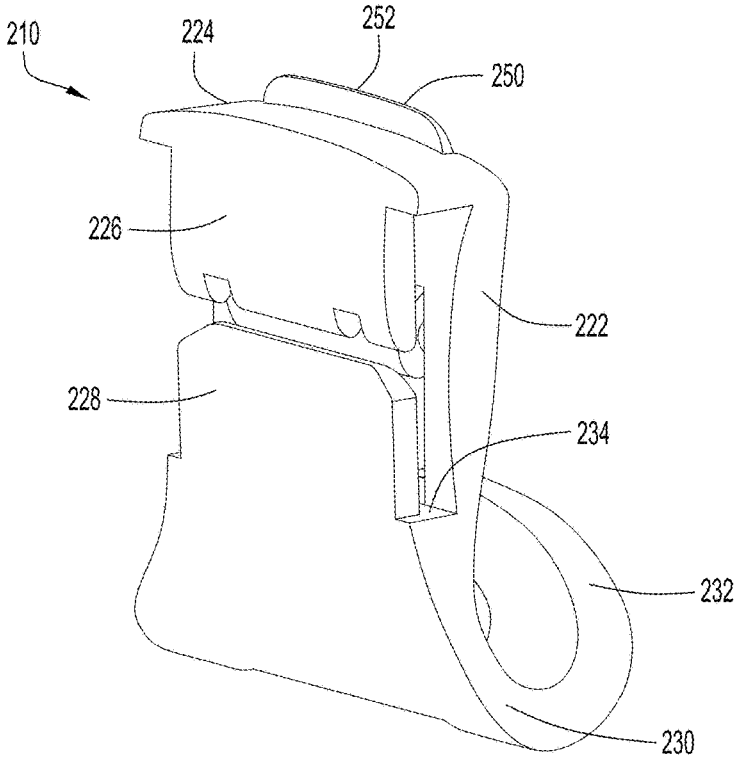
Figure 2E:
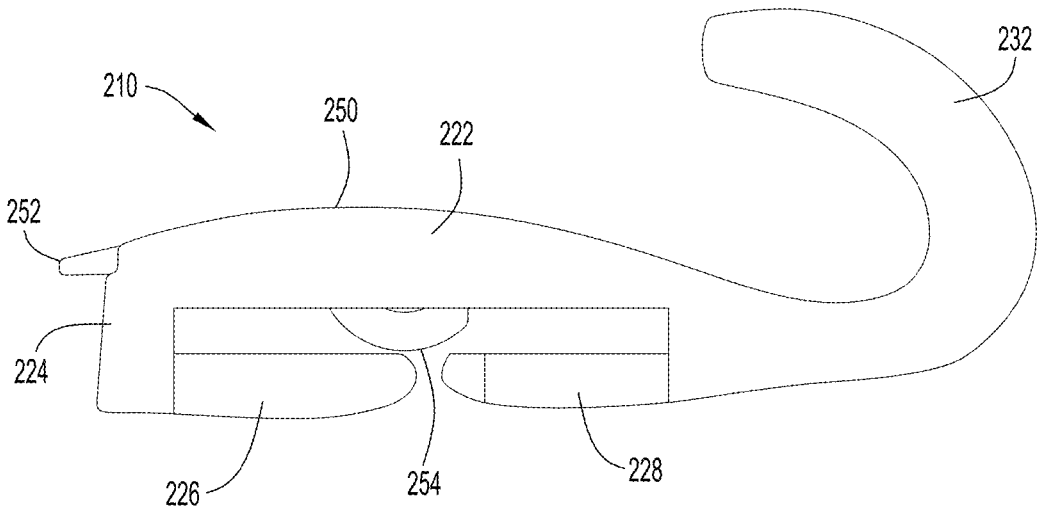
Figure 2F:
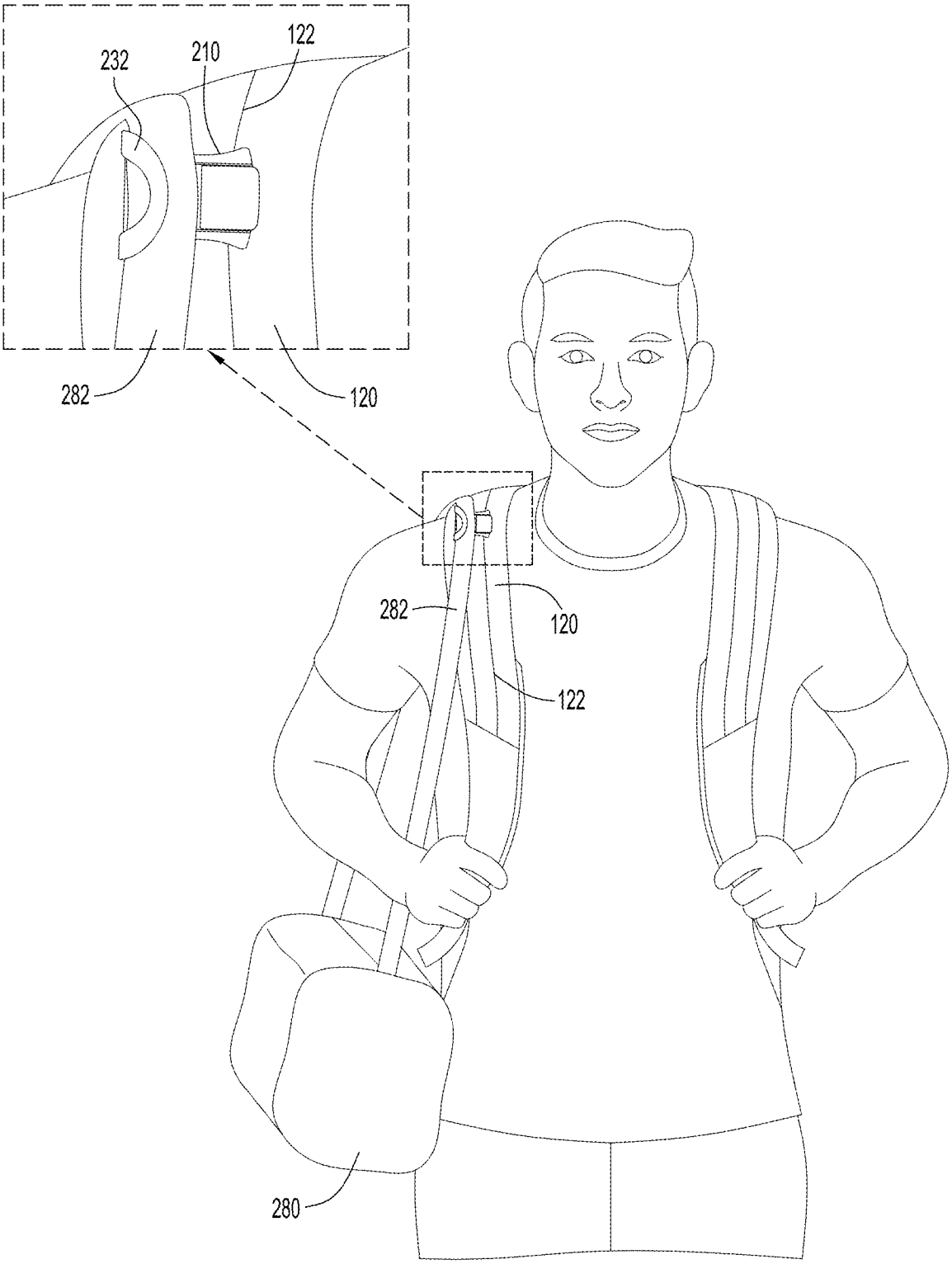
FIG. 2F is a partial view of the backpack being worn by a user with an accessory coupled to the strap via a clip of the backpack.

The straps 120 can also comprise panels formed of one or more layers of material that can be the same or similar materials as the layers forming panels for the main body of the backpack as described herein. For example, the panels defining the straps can be formed of one or more fabric materials including a plurality of layers with one or more intermediate foam layers provided between inner and outer fabric layers. Each shoulder strap 120 is suitably dimensioned to allow a user to place an arm through the gap between the strap and the main body so as to wear the backpack with the straps extending over the shoulders of the user and the rear side 104 of the backpack aligned with and touching/engaging (or in close proximity with) the user's back. Thus, the shoulder straps 120 facilitate support of the backpack 100 by the shoulders of the user wearing the backpack (e.g., as depicted in FIG. 2F). At a lower end of each strap 120 is a length adjustment mechanism 126 (which can be implemented, e.g., in the form of a strap and buckle assembly) that facilitates lengthening or shortening a length dimension of each strap 120 to accommodate a variety of users having bodies of varying sizes as well as an adjustment of the location (higher or lower) of the backpack location against a user's back when the backpack 100 is worn by the user. A further pair of cross-wise straps 123 are provided, where each cross-wise strap 123 extends transversely from a respective shoulder strap 120 toward the other cross-wise strap 123 and the two straps 123 connect to each other at their free ends via any suitable fastener engagement (e.g., via a bulk strap buckle connection). In use, the transverse straps 123 can be connected to each other when the backpack 100 is worn by the user so as to maintain or enhance the engagement of the shoulder straps 120 with and support of the backpack by the user's shoulders.

Each shoulder strap 120 includes a material layer, such as a fabric layer, that is partially secured (e.g., via stitching, adhesion, or in any other suitable manner) so as to form a guide or rail 122 for a clip 210. In particular, each rail 122 comprises a strip of fabric or other material having suitable length and width dimensions to extend a selected distance along each strap 120 to which the rail is secured. Each rail 122 is secured at each of its ends to an outward surface of a corresponding strap 120 (i.e., the surface of the strap that faces away from the rear side 104 of the backpack 100). Each rail 122 is further secured to the corresponding strap 120 (e.g., via stitching) so that the lengthwise dimension of the rail corresponds with the lengthwise dimension of the strap and the rail is generally aligned along a lengthwise central axis of the strap. For example, each rail 122 extends partially along the length of its corresponding strap 120, extending at an upper location of the strap to a distance at about a midpoint of the length of the strap. The opposing, edge portions that extend in the lengthwise direction of each rail are not secured and thus are free or separated from the strap 120 to which the rail is secured. The unsecured and free lengthwise extending edge portions of each rail 122 facilitate engagement with the clip 210 as described herein. Further, a clip 210 can be coupled with the rail 122 of either strap 120 in the same or similar manner as described herein.

Referring to FIGS. 2A-2E, an example embodiment is depicted of a clip 210 that couples with (e.g., is removably secured to) a rail 122 on the backpack strap 120. The clip 210 includes a rail securing member 220 that secures the clip to the rail 122 and an accessory engagement member 230 that is configured to engage with and secure accessories to the backpack shoulder strap 120 so as to support such accessories when the backpack 100 is worn by the user in a manner as described herein. The rail securing member 220 includes a main portion that comprises a pair of elongated arms 222 (i.e., first and second elongated arms) each of which extends away from an end 234 of the engagement member 230 that faces the rail securing member 220. The arms 222 are spaced from each other and extend to a terminal or free end 224 of the clip 210, where the free end 224 extends transversely between and connects with corresponding ends of the two arms 222 so as to form a generally rectangular opening defined between the ends 224, 234 and the arms 222 of the clip 210.

The free end 224 of the clip 210 at the rail securing member 220 extends downward (i.e., in a direction toward the backpack strap 120 when the clip 210 is secured thereon) from the arms 222, and a first cantilever member 226 is located below the arms 222 and extends from a surface of the free end 224 in a direction toward the engagement member 230. A corresponding downward oriented second cantilever member 228 extends from a surface of the engagement member end 234 also at a location below the arms 222 and in a direction toward the rail securing member free end 224 and a terminal end of the first cantilever member 226. The first and second cantilever members 226, 228 are in alignment with and terminate a suitable distance from each other to define a small gap therebetween. The cantilever members 226, 228 are also spaced a slight distance from the arms 222 such that there is also a small gap defined therebetween.

A securing lever 250 is pivotally connected between and at approximately a center location along the length of the pair of arms 222. The securing lever 250 is further located along an upward facing side of the clip 210 (i.e., a side of the clip facing away from the backpack strap 120 when the clip 210 is secured thereon) and above the cantilever members 226, 228. The lever 250 has a generally rectangular configuration and includes a free end 252 that extends slightly beyond the free end 224 of the clip 210. The lever 250 includes a pivotal connection at a pivot point along each of its lengthwise sides (at a selected location distanced from the free end 252) with a portion of a corresponding arm 222 to facilitate rotational and pivotal movement of the lever in relation to the arms 222. The lever 250 is further configured such that, when pivoted to a locking position in which it is generally oriented flat and parallel with arms 222, an underside portion of the lever 250 pushes against the rail 122 to frictionally engage the clip 210 into a locking position against the rail 122 (as shown in FIG. 2A). For example, the lever 250 can include a tab or locking member 254 that extends downward from a lower surface portion of the lever and is forced toward and against the rail 122 when the clip is secured thereto (see FIG. 2E), and this locking member 254 pushes against the rail to frictionally engage and prevent movement of the clip along the rail when the lever is in the locking position. When the lever 250 is pivoted such that its free end 252 is tilted upward and away from the arms 222 such that the lever 250 is no longer flat or parallel with the arms 222 (as shown in FIG. 2B), the lever 250 and its locking member 254 are in an unlocked position and do not push against the rail 122 thus allowing the clip 210 to freely move or slide to another position along the rail. In other words, the clip 210 can be selectively moved or slidably adjusted along the rail 122 to different positions along the strap 120, by adjusting the lever 250 in its locked position (FIG. 2A) and unlocked position (FIG. 2B) without disengaging the clip 210 from the rail 122.

The curved engagement member 230 includes a portion 232 that extends from end 234 and curves upward (i.e., in a direction away from the rail 122 and strap 120) and over or upon itself to form a general U-shape, where a terminal end 233 of the curved portion 232 lies above the end 234 and faces toward the free end 224. The terminal end 233 also has a curved or arcuate edge. The curved portion 232 can further include a cut-out section in its central area that defines an opening extending through the curved portion at this location.

The clip configuration allows the clip 210 to be coupled with the rail 122, where the lengthwise dimension of the clip is positioned transverse the lengthwise dimension of the rail (e.g., as depicted in FIGS. 1B, 2A and 2B). With this connection, the curved portion 232 of the engagement member 230 extends in a direction away from the rail 122 and toward a widthwise side of the strap 120. Connection of the clip 210 with the rail 122 is achieved by orienting the clip such that the curved portion 232 faces outward (i.e., away from the strap) and toward a side of the strap 120 that is at or near a corresponding lengthwise edge of the rear side 104 of the backpack 100. With such orientation, the cantilever members 226, 228 are inserted underneath opposing lengthwise edge portions of the rail 122 that are free or unattached to the strap 120. The lever 250 can be oriented in the unlocked position (as shown in FIG. 2B) when the clip 210 is secured via its cantilever members 226, 228 to the rail 122. After insertion of each cantilever member 226, 228 underneath the free lengthwise edge portions of the rail 122, the arms 222 extend above and across the rail to effectively hold the clip 210 against the rail. In this configuration, the clip 210 can further slide along the rail 122 as far as the lengthwise free edge portions of the rail will permit. The lever 250 can be maintained in a position with its free end being moved away from the arms 222 (as shown in FIG. 2B) to facilitate sliding movement of the clip 210 along the rail 122 to a desired position. When a desired position is determined, the lever 250 can be pushed downward so that it lies flat and generally parallel with the arms 222 (as shown in FIG. 2A) to frictionally engage the lever with the rail 122 and lock the clip 210 in place in relation to the rail.

In use, the clip 210 can be secured along the rail 122 of a strap 120 so that, when the backpack 100 is worn, the clip 210 is located at or near the shoulder of the user of the backpack (clip 310, as described herein, can be secured to the rail in a similar manner). As shown in FIG. 2F, this allows a user to secure an item on the engagement member 230 of the clip 210 so that it is supported by the backpack 100 being worn by the user. For example, a duffle bag, purse, or any other item or container having a handle or strap can be coupled with the clip 210 by hanging or looping the handle or strap of the item around the curved portion 232 of the clip 210. As shown in FIG. 2F, a handle or strap 282 of a bag 280 (e.g., a duffle bag) is looped or hung around so as to couple with the curved portion 232 of the clip 210 so that the bag can be supported by the backpack when worn by the user (thus freeing the user's hands from having to carry the bag). Other items (e.g., small containers, keys, etc.) can also be secured to the clip 210 by insertion and connection of a carabiner or other suitable fastener through the cut-out section/opening in the central area of the curved portion 232 to allow the item to attach and hang via its fastener from the clip 210 when the backpack is worn by a user. As further shown in FIG. 2F, the clip 210 is secured to the rail 122 with the curved portion 232 projecting outward and away from a lengthwise central axis of the backpack 100. However, the clip 210 can also be oriented in another manner, e.g., rotated 180° so that the curved portion 232 projected toward the lengthwise central axis of the backpack. In either configuration, the clip 210 can be configured for engaging with and supporting accessories (e.g., duffle bags, purses, etc.). In addition, since each strap 120 of the backpack 100 includes a rail 122, the clip 210 (or clip 310) can be removably secured to either rail 122 for use on either strap 120 of the backpack in the same or substantially similar manner as described herein.

Figure 3:
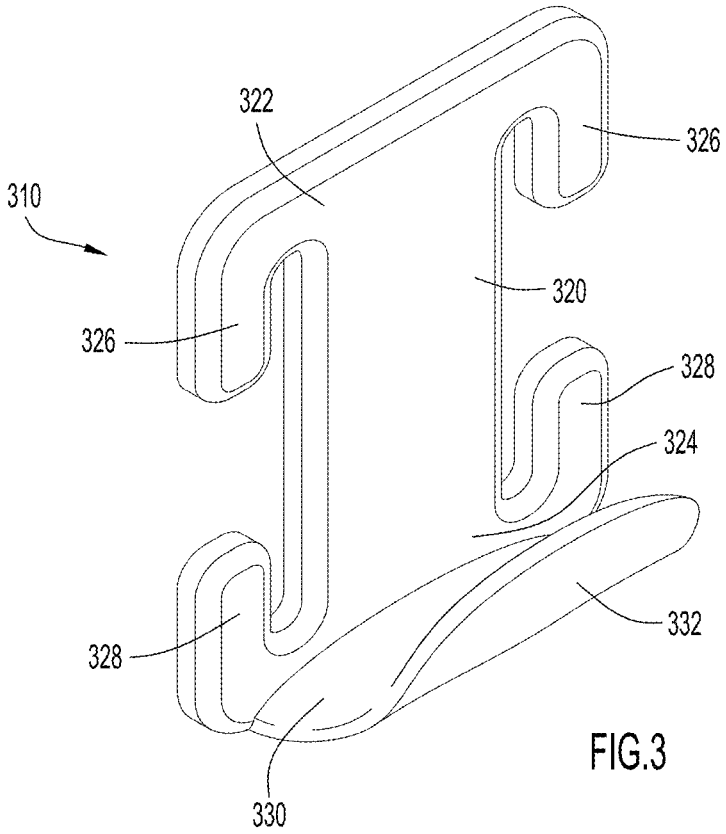
FIG. 3 depicts another embodiment of a clip configured to couple with a strap of the backpack of FIG. 1A and for supporting an accessory during use of the backpack.

The clip can also have a different configuration that achieves the same functional features when combined with a backpack strap as described herein. For example, another embodiment of a clip is depicted in FIG. 3. In this embodiment, the clip 310 includes a rail securing member 320 and an accessory engagement member 330, where the engagement member 330 includes a curved portion 332 that curves upward and has a general U-shape to facilitate coupling of a handle or strap of an item to the clip when the clip is secured to the strap rail 122. The rail securing member 320 includes a first section 322 at a free end and a second section 324 at an end that connects with the member 330, where the first and second sections 322, 324 extend lengthwise in a direction transverse a lengthwise extending central portion of the member 320 so as to extend beyond the width and on each side of the central portion to define a "T" shape at each end of the member 320. The first and second sections 322, 324 curve at their free lengthwise ends to form a first pair of cantilever members 326 (which extend from the first section 322) and a second pair of cantilever members 328 (which extend from the second section 324), where the cantilever members are generally coplanar with the central portion of the member 320. The cantilever members 326 extend toward the cantilever members 328 to define a small gap therebetween. Similar to the clip 210, the cantilever members 326, 328 of the clip 310 facilitate an attachment of the clip to the strap rail 122 by orienting the clip 310 in a clip lengthwise dimension across the rail 122 so that the cantilever members can be inserted beneath the free portions of the rail while the central portion of the clip abuts against the rail. This configuration facilitates engagement with and sliding movement of the clip 310 along the rail 122. The accessory engagement member 330 operates in a similar manner as the member 230 for the clip 210, where items such as duffle bags, purses and/or other bags or containers can be supported via a strap or handle for the container being looped over the curved portion 332 so that the container can be supported by the backpack during use.

The backpack includes other features including a number of pockets or enclosures that facilitate carrying of numerous items of varying shapes and sizes. For example, referring to FIGS. 4A-4D, an enclosure for a laptop or other electronic device and/or other types of items is provided at the rear side 104 of the backpack 100 via a plurality of panels that are partially separable from each other via a zipper or other suitable fastener.

Figure 4A:
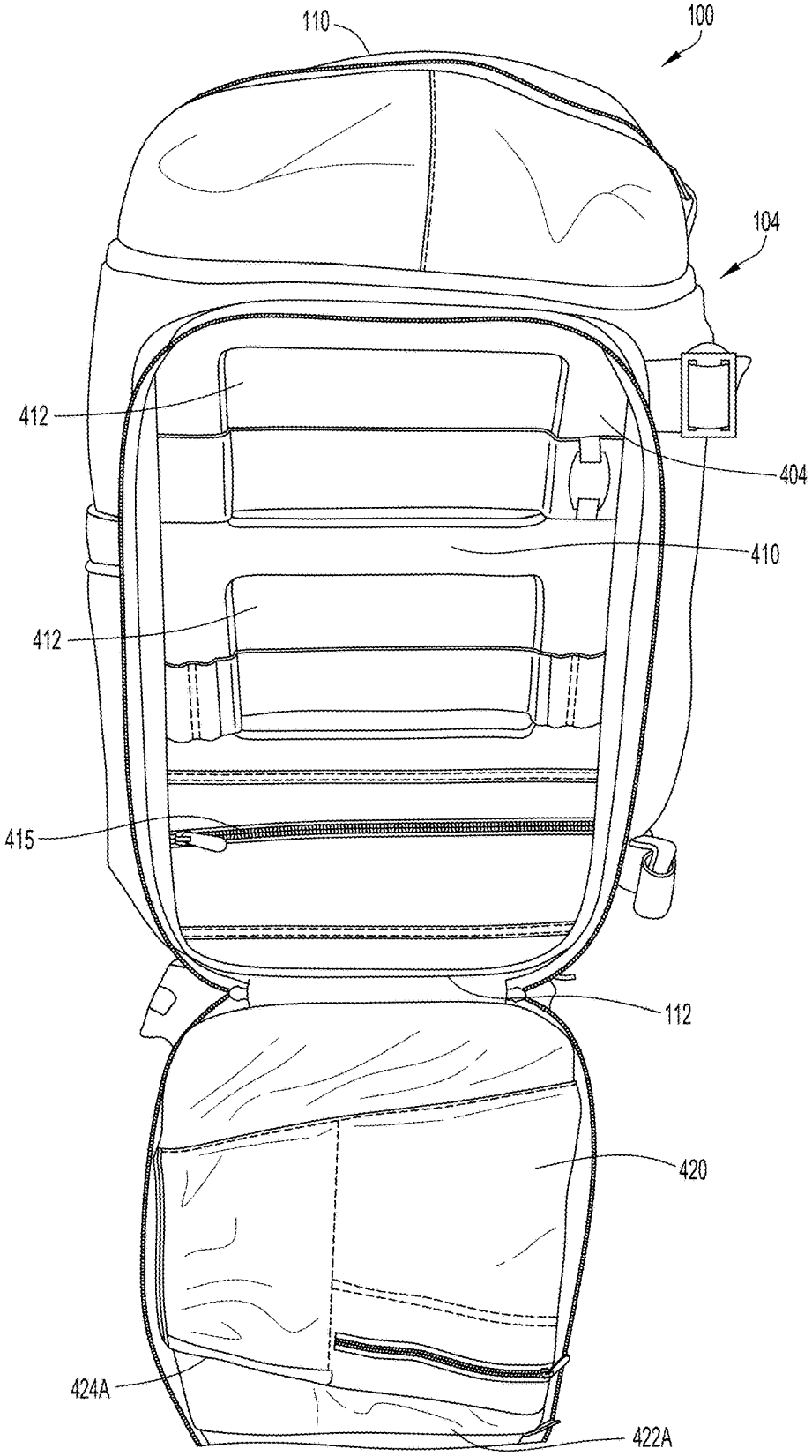
FIGS. 4A-4D depict views of panels forming the rear side of the backpack, in which two panels of the rear side are separated from each other to show a plurality of enclosures or pockets located between the panels at the rear side.

In an example embodiment of the backpack 100 as depicted in FIG. 4A, the rear side 104 includes a first panel 404 that connects with the left and right sides 106, 108 of the backpack 100 and a second panel 420 that is pivotally connected with the first panel 404 at a location near the bottom side of the two panels that correspond with the backpack bottom side 112. A zipper or other suitable fastener extends around the remaining sides of the two panels to facilitate coupling together and partial separation of the two panels to facilitate access to an enclosure defined between the panels 404, 420. For example, as shown in FIG. 4A, panel 420 can be separated from panel 404 along three edges of each of the panels (where both panels remain connected together along the lower or bottom edge of the backpack) via a zipper (or other fastener) such that both panels can lay flat in a generally coplanar configuration with each other. The enclosure can be defined by a two dimensional surface area that is the same or similar as the areas defined by the facing surfaces of the panels 404, 420 and further defined by at least a portion of the general length and width dimensions of the backpack. The enclosure defined between the panels 404, 420 can also be suitably dimensioned to receive, e.g., a laptop, books, or other suitable items depending upon a particular use of the backpack.

Figure 4B:
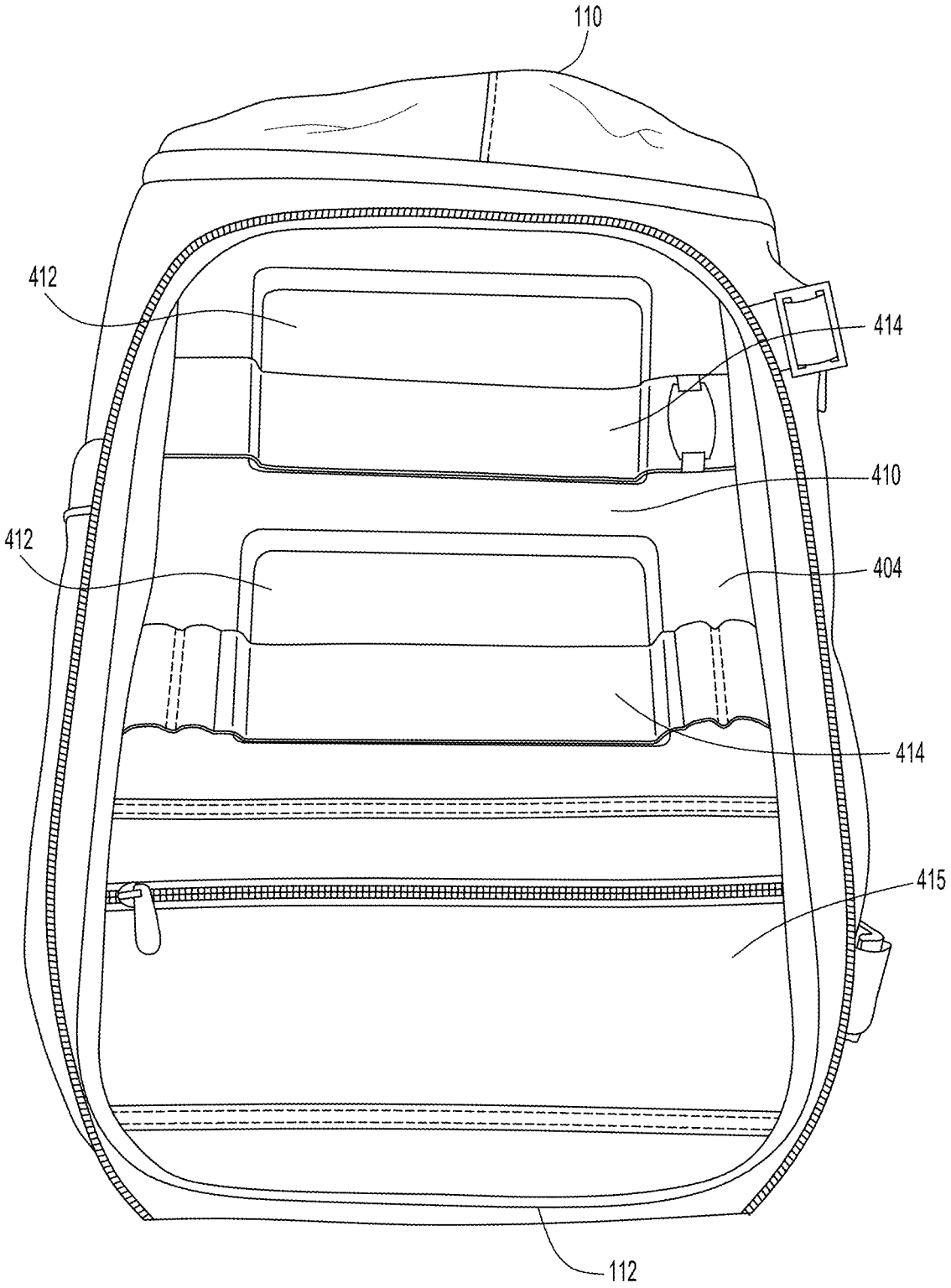

Referring to FIG. 4B, panel 404 includes a plastic or other suitably rigid and molded material 410 secured to the panel surface that faces outward and away from the backpack front side 102, where the material 410 is shaped to form indentations that define two indentations or recesses 412 along the panel 404. A flexible band 414 is secured to the material 410 at each recess, where each flexible band 414 extends across the corresponding recess 412 to provide a flexible holding strap for items placed within the recess 412. The panel 404 can further include any number of other compartments, enclosures or pockets (e.g., compartment 415, which can be open and closed with a zipper fastener as depicted in FIG. 4B), loops, clips and/or other fasteners that facilitate securing of keys, pens, pencils, a stylus, etc. to surface portions of the panel. The pockets or compartments (e.g., compartment 415) can comprise a fabric material that is secured to the panel surface along any number of sides that facilitates formation of at least a partially enclosed pocket or compartment.

Figure 4C:
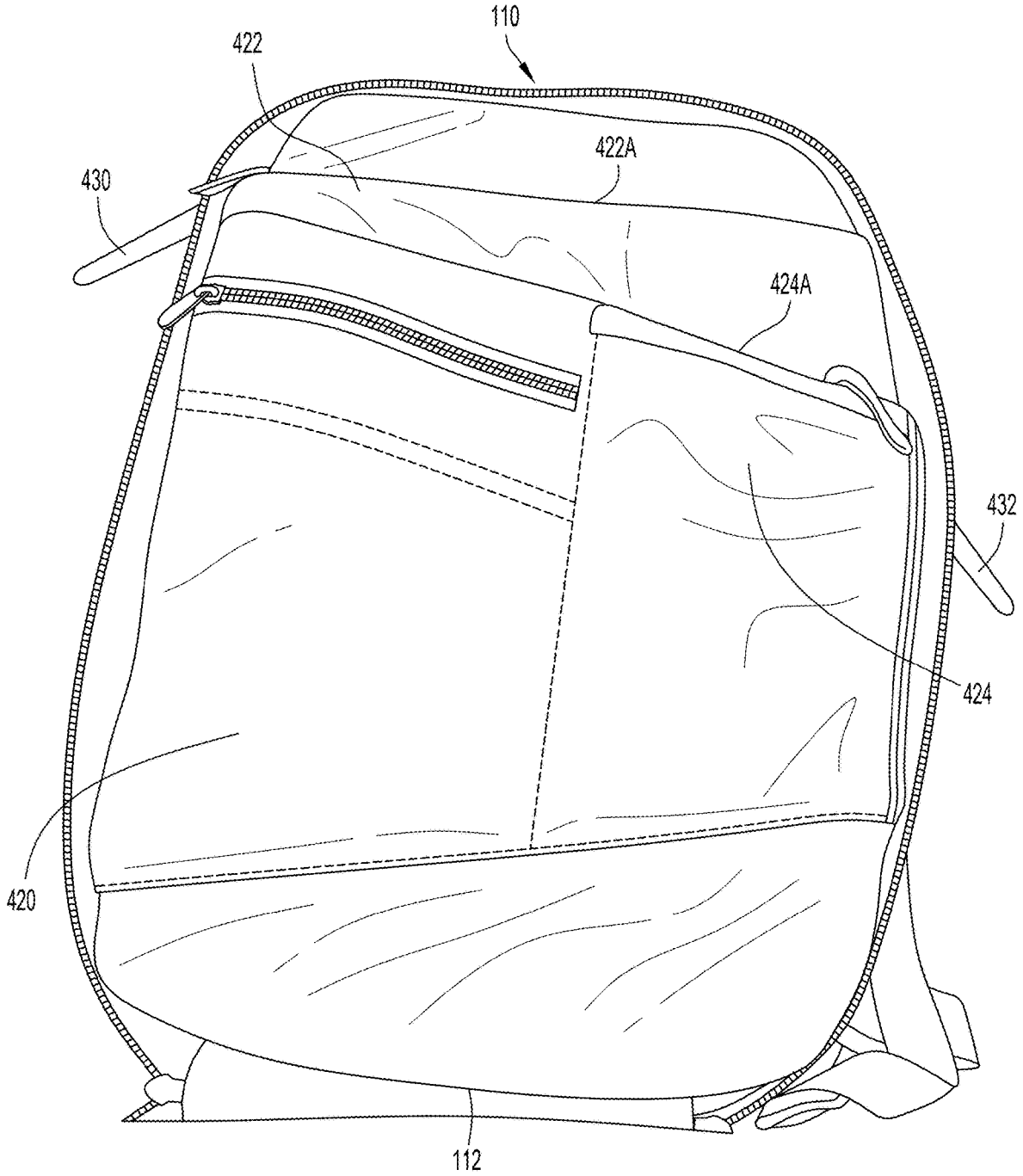
Figure 4D:
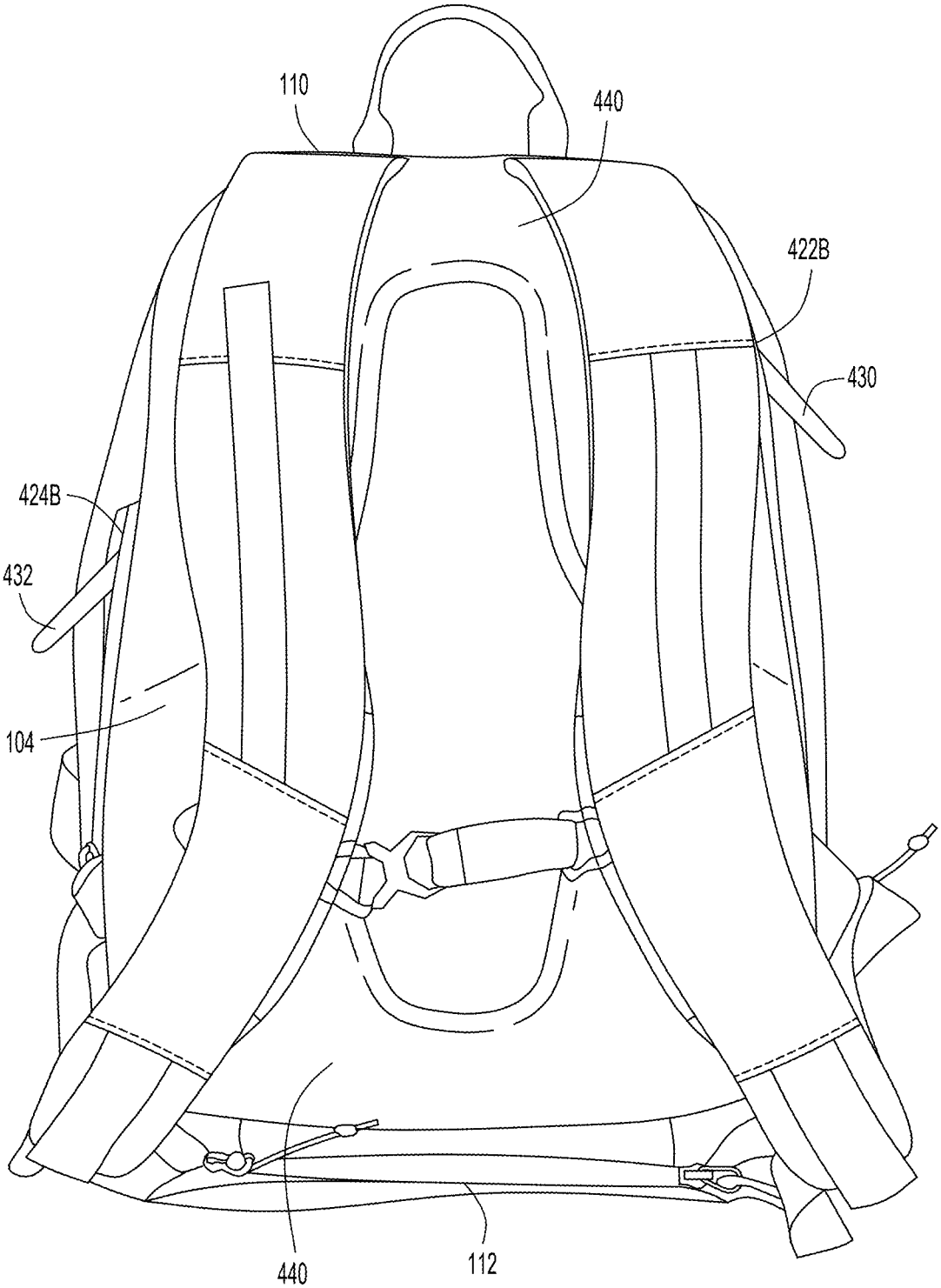

Referring to FIGS. 4C and 4D, the panel 420 includes an exterior surface that faces away from the panel 420 and forms the outer surface of the backpack rear side 104. The panel 420 includes a plurality of pockets or compartments formed along the interior surface of the panel (i.e., the surface that faces toward panel 404 and is within the enclosure when the panels 404, 420 are connected together with the zipper/fastener), where some of the pockets can be selectively closed via a zipper or other suitable fastener.

In addition, at least one pocket or compartment can facilitate dual entry from both the interior surface of the panel 420 (when the panel 420 is open or separated from panel 404) and the exterior surface of the panel 420 (when the panel 420 is secured to the panel 404 along each of its sides via the zipper/fastener). For example, a first dual entry pocket 422 is provided along the interior surface of the panel 420 that comprises a fabric or other suitable material secured to the panel interior surface along each of its sides and further includes a first opening 422A to the pocket 422 that is accessible at the panel interior surface. The pocket 422 can be suitably dimensioned to receive and accommodate a personal electronic device or other suitable item. The pocket 422 is further accessible along the exterior surface of the panel 420 (i.e., at the rear side 104 of the backpack 100) via another or second opening 422B that includes a zipper or other fastener (i.e., the second opening 422B is at the exterior surface of the panel 420 communicates with the pocket 422 at the interior surface of the panel 420). This can be seen in FIGS. 4C and 4D with a stylus 430 that extends within the pocket 422 and also through each of the first and second openings 422A, 422B.

Another dual pocket 424 (e.g., suitably sized to receive a cellular phone or other suitable item) is provided along the interior surface of the panel 420 that is similar in configuration to pocket 422 and includes a first opening 424A that is accessible at the panel interior surface and a second opening 424B that includes a zipper or other fastener and is accessible at the exterior surface of the panel 420 (i.e., at the rear side 104 of the backpack 100). A stylus 432 is depicted in FIGS. 4C and 4D which extends within the pocket 424 and also through each of the first and second openings 424A, 424B.

The dual pocket openings allow a user to effectively place, secure and remove an item within the pocket of the panel 420, where the item is accessible within the enclosure between the first and second panels 404, 420 when they are separated (i.e., via the first pocket opening along the panel interior surface) and also when they are secured together (i.e., via the second pocket opening along the panel exterior surface). In other words, each of the pockets 422, 424 are accessible from the exterior of the backpack (when panels 404, 420 are connected together to define an enclosure therebetween) and the interior of the backpack (e.g., when panel 420 is partly separated from panel 404). In addition, for electronic items (e.g., cellular phones, laptops or other electronic equipment), the pockets with dual openings allow an electronic item to be stored safely within the backpack pockets or compartments while allowing accessories associated with the electronic item (e.g., electronic wiring for a headset, a power cord, etc.) to be utilized outside of or external to the backpack.

The backpack 100 can include any suitable number of further pockets, enclosures, compartments, etc. along other exterior surfaces of any side of the backpack (e.g., a pocket formed along either or both the left and right sides of the backpack to facilitate securing of a water bottle or other item with the backpack during use). In addition, the backpack can include any other suitable types of securing structure to facilitate attachment of one or more items to the backpack for carrying during use of the backpack.

For example, referring again to FIGS. 1A and 1E, a generally rectangular sheet 150 of molded polymer material can be integrated with the panel forming part or all of the front side 102 of the backpack 100. The sheet 150 can be secured between fabric layers of the front side 102, where the sheet 150 is secured along its periphery or peripheral side portions to the front side 102. A main portion including the center of the sheet 150 is not secured to the backpack front side, thus allowing for this main portion of the sheet 150 to be pulled slightly outward from the backpack front side. In an example embodiment, the molded polymer material comprises a rubber or other elastomeric material having a sufficient hardness and that is sufficiently tear resistant, such as a chlorosulfonated polyethylene synthetic rubber commercially available under the tradename HYPALON (DuPont de Nemours, Inc.). The sheet 150 includes a plurality of generally rectangular windows or openings 152 aligned in an array of rows and columns. The free and unsecured portions of the sheet 150 combined with the array of openings 152 along the main portion combine to define vertically and horizontally extending connection portions 154 of the sheet 150. These connection portions 154 facilitate connections of items to the sheet 150, such as keys, personal device accessories (e.g., a case 182 for earbuds as shown in FIG. 1E) and/or any other types of items that can connect via a suitable connecting structure such as a carabiner, a cord, a rope or a chain (e.g., by looping the connecting structure/carabiner 180 around and/or between one or more connection portions 154 of the sheet, as shown, e.g., in FIG. 1E). Thus, the sheet 150 functions as a molle board for connection of multiple items to the backpack for transport with the backpack during use.

Figure 5:
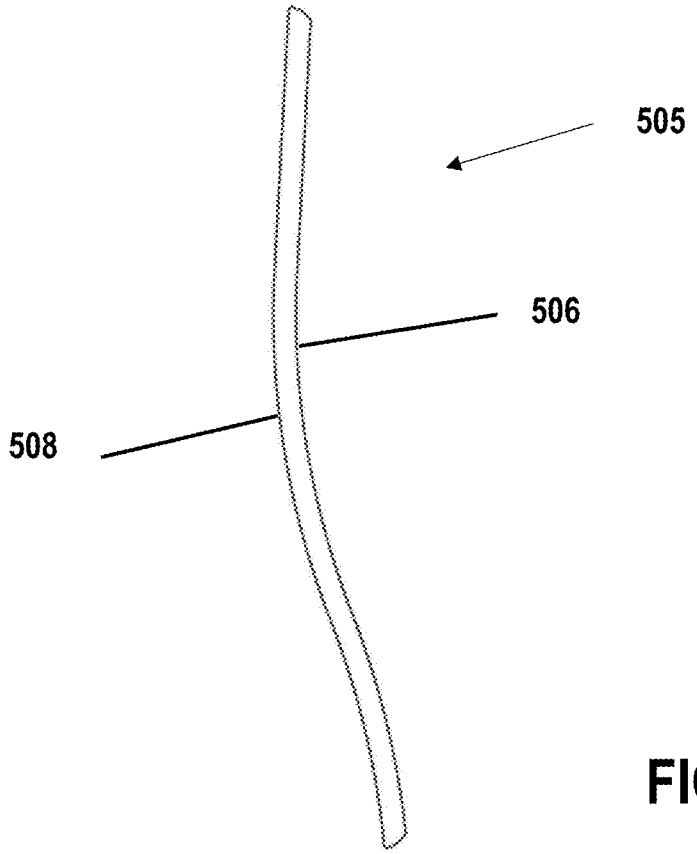
FIG. 5 is a view of a curved insert or support plate that is provided between interior and exterior layers of a rear side panel of the backpack of FIG. 1A.

The backpack 100 also includes an ergonomic feature that comprises a thin, curved member or plate 505 (depicted in isolation in FIG. 5) that forms an insert or an intermediate, internal layer between inner and outer layers of the panel 420 for the backpack rear side 104. The curved plate 505 has a curved contour with rounded concave and rounded convex portions on each of its surfaces such that the curvature generally resembles the curved contour of a human spine. In particular, the curved plate 505 includes a first curved surface 506 and an opposing, second curved surface 508. The first curved surface 506 includes an upper concave region that corresponds with an upper convex region along the second curved surface 508. The first curved surface 506 further includes a lower convex region that corresponds with a lower concave region along the second curved surface 508. The curved plate 505 can be formed of a suitably hard and rigid material (e.g., nylon, polyethylene terephthalate, polyvinyl chloride and/or or any other suitably hard and rigid plastic) that, when placed within the panel 420, translates its curved contour to the exterior surface of the panel 420 that forms the backpack rear side 104. For example, referring to FIGS. 1C and 1D, the rear side 104 has a curved surface 510 that corresponds with the curvature of the curved plate 505 disposed between layers of the panel 420 that forms the rear side. This curved contour of the curved plate 505, when combined with suitable placement of the backpack 100 against a user's back (e.g., appropriately adjusting the lengths of the straps 120), facilitates a complementary curvature of the exterior surface of the panel 420 with the curvature of the user's back so as to provide a comfortable engagement therewith. The panel 420 can further include soft foam (e.g., polyurethane foam) at portions 440 along the exterior surface of the panel 420 (e.g., near the top and bottom of the panel) that correspond with contours of the plate 505 and which provide cushioning against a user's back when the backpack is worn by the user. A central portion 445 of the panel that is located between the foam portions 440 can be formed of a harder or more rigid material (e.g., ethylene vinyl acetate plastic).

Thus, the backpack described herein provides a number of enhancement features that facilitate support and transport of numerous types and sizes of items by the backpack when it is worn by the user while also enhancing comfort and ergonomic features of the backpack for the user.

The backpack clip facilitates support of items such as duffle bags, purses and/or any other types of items that may include a handle or strap so that the user does not have to separately carry such items using his or her hands. The molded sheet that defines a molle board at the front side of the backpack also facilitates support and transport of further items (e.g., car keys or other items) that are also easily accessible to be removed/separated from the backpack. The numerous pockets or compartments of the backpack facilitate securing and transport of different types of items (electronic components, books, exercise clothing, jackets or other apparel, water bottles, etc.) by the backpack as well as easy access to some of the pockets or compartments that are configured to have dual access both internally or within the backpack as well as externally or outside of the backpack. The curved plate that is placed within the panel forming the rear side of the backpack combined with cushion members provide enhanced comfort and conformability of the rear side of the backpack to the user's back during use of the backpack.

It is intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration.

What is claimed:

1. A backpack comprising:

a main body including a front side and a rear side;

a pair of shoulder straps extending from the rear side, wherein one of the shoulder straps includes a rail secured on and extending along a surface of the shoulder strap that opposes the rear side, the rail comprising a strip of material secured along a lengthwise portion of the shoulder strap while lengthwise extending edge portions of the rail are unsecured to the shoulder strap; and a clip that secures to the rail of the shoulder strap, wherein the clip comprises:

a rail securing member that secures to the rail, wherein the rail securing member includes securing elements located at a first side that faces the rail when the clip is secured to the rail, and the rail securing member includes a second side that opposes the first side; and an accessory engagement member comprising a curved, U-shaped member that extends away from an end of the rail securing member so as to curve outward and away from the second side of the rail securing member and the rail, and the U-shaped member is dimensioned to receive and retain a loop, a strap or a handle of an item to be supported by the backpack via the clip when the backpack is worn by a user and the loop, strap or handle of the item is coupled with the U-shaped member, wherein the U-shaped member includes a cut-out section that defines an opening through the U-shaped member.

2. The backpack of claim 1, wherein the securing elements of the rail securing member comprise:

a main portion;

a first cantilever member that extends from the first side at a first end of the main portion; and a second cantilever member that extends from the first side at a second end of the main portion and toward the first cantilever member, wherein the first and second cantilever members are spaced a distance from each other to define a gap therebetween;

wherein each cantilever member is sufficiently dimensioned to fit underneath an unsecured lengthwise extending edge portion of the rail so as to secure the clip to the rail.

3. The backpack of claim 2, wherein the main portion of the rail securing member comprises a first arm and a second arm spaced from the first arm, each of the first and second arms extends from the end of the rail securing member from which the accessory engagement member extends to a free end of the clip, and the first and second cantilever members are disposed below and at a distance from the first and second arms such that the rail fits between the first and second arms and the first and second cantilever members when the clip is secured to the rail.

4. The backpack of claim 1, wherein the clip is movable along the rail and in a lengthwise dimension of the shoulder strap to which it is secured.

5. The backpack of claim 4, further comprising a lever that is pivotally mounted in relation to the main portion to selectively secure the clip to a fixed position in relation to the rail and the shoulder strap.

6. The backpack of claim 1, wherein the rear side comprises:

a first panel secured to the front side of the main body; and a second panel removably secured to the first panel, wherein the second panel defines the rear side of the main body;

wherein an enclosure is defined between the first and second panels to secure one or more items within the backpack.

7. The backpack of claim 6, wherein the second panel comprises:

an interior surface that faces toward the first panel when the second panel is secured to the first panel;

an exterior surface that faces away from the first panel when the second panel is secured to the first panel; and a pocket defined between the interior and exterior surfaces of the second panel, wherein the pocket includes a first opening that is accessible via the interior surface and a second opening that is accessible via the exterior surface.

8. The backpack of claim 6, further comprising:

a curved plate formed of a plastic material disposed within the second panel, wherein the curved plate includes a first curved surface and an opposing second curved surface, the first curved surface including an upper first concave region and a lower first convex region disposed below the upper first concave region, the second curved surface includes an upper second convex region that corresponds with the upper first concave region of the first curved surface and a lower second concave region that corresponds with the lower first convex region of the first curved surface.

9. The backpack of claim 1, further comprising:

a sheet of molded polymer material secured along peripheral side portions of the sheet to the front side of the backpack, wherein a central portion of the sheet is unsecured to the backpack front side and includes a plurality of openings arranged in an array of rows and columns.

10. A clip that is securable to a shoulder strap of a backpack, the clip comprising:

a rail securing member that secures to a rail of the shoulder strap, wherein the rail securing member includes securing elements located at a first side that faces the rail when the clip is secured to the rail, and the rail securing member includes a second side that opposes the first side; and an accessory engagement member comprising a curved, U-shaped member that extends from an end of the rail securing member so as to curve outward and away from the second side of the rail securing member, and the U-shaped member is dimensioned to receive and retain a loop, a strap or a handle of an item to be supported by the backpack via the clip when the backpack is worn by a user and the loop, strap or handle of the item is coupled with the U-shaped member, wherein the U-shaped member includes a cut-out section that defines an opening through the U-shaped member.

11. The clip of claim 10, wherein the securing elements of the rail securing member comprise:

a main portion;

a first cantilever member that extends from the first side at a first end of the main portion; and a second cantilever member that extends from the first side at a second end of the main portion and toward the first cantilever member, wherein the first and second cantilever members are spaced a distance from each other to define a gap therebetween;

wherein each cantilever member is sufficiently dimensioned to fit underneath an unsecured lengthwise extending edge portion of the rail so as to secure the clip to the rail of the backpack.

12. The clip of claim 11, wherein the main portion of the rail securing member comprises a first arm and a second arm spaced from the first arm, each of the first and second arms extends from the end of the rail securing member from which the accessory engagement member extends to a free end of the clip, and the first and second cantilever members are disposed below and at a distance from the first and second arms such that the rail fits between the first and second arms and the first and second cantilever members when the clip is secured to the rail.

13. The clip of claim 10, further comprising a lever that is pivotally mounted in relation to the main portion to selectively secure the clip to a fixed position in relation to the rail and the shoulder strap of the backpack when the clip is secured to the rail.

14. A backpack comprising:

a main body including a front side and a rear side;

a pair of shoulder straps extending from the rear side, wherein one of the shoulder straps includes a rail secured on and extending along a surface of the shoulder strap that opposes the rear side, the rail comprising a strip of material secured along a lengthwise portion of the shoulder strap while lengthwise extending edge portions of the rail are unsecured to the shoulder strap;

a clip that secures to the rail of the shoulder strap, wherein the clip comprises an accessory engagement member comprising a curved, U-shaped member that is dimensioned to receive and retain a loop, a strap or a handle of an item to be supported by the backpack via the clip when the backpack is worn by a user and the loop, strap or handle of the item is coupled with the U-shaped member, wherein the U-shaped member includes a cut-out section that defines an opening through the U-shaped member;

a first panel secured to the front side of the main body;

a second panel removably secured to the first panel, wherein the second panel defines the rear side of the main body; and an enclosure is defined between the first and second panels to secure one or more items within the backpack;

wherein the second panel comprises:

an interior surface that faces toward the first panel when the second panel is secured to the first panel;

an exterior surface that faces away from the first panel when the second panel is secured to the first panel; and a pocket defined between the interior and exterior surfaces of the second panel, wherein the pocket includes a first opening that is accessible via the interior surface and a second opening that is accessible via the exterior surface.

* * * * *